US006806859B1

(12) United States Patent
Kanoh et al.

(10) Patent No.: US 6,806,859 B1
(45) Date of Patent: Oct. 19, 2004

(54) SIGNAL LINE DRIVING CIRCUIT FOR AN LCD DISPLAY

(75) Inventors: Hideki Kanoh, Tokyo (JP); Michio Takuma, Saitama (JP); Yoshiaki Nakazato, Saitama (JP)

(73) Assignee: Texas Instruments Incorporated, Dallas, TX (US)

( * ) Notice: Subject to any disclaimer, the term of this patent is extended or adjusted under 35 U.S.C. 154(b) by 1102 days.

(21) Appl. No.: 08/678,255

(22) Filed: Jul. 11, 1996

(30) Foreign Application Priority Data

Jul. 11, 1995 (JP) ..... 7-198104

(51) Int. Cl.[7] ..... G09G 3/36
(52) U.S. Cl. ..... 345/98; 345/100
(58) Field of Search ..... 345/87, 89, 147, 345/100, 95, 94, 98

(56) References Cited

U.S. PATENT DOCUMENTS 5,168,270 A * 12/1992 Masumori et al. ..... 345/100
5,414,443 A * 5/1995 Kanatani et al. ..... 345/95
5,617,111 A * 4/1997 Saitoh ..... 345/100

* cited by examiner

*Primary Examiner*—Richard Hjerpe
*Assistant Examiner*—R. Laneau
(74) *Attorney, Agent, or Firm*—Bret J. Petersen; W. James Brady, III; Frederick J. Telecky, Jr.

(57) ABSTRACT

A signal line drive circuit for an LCD display having a reduced chip size and circuit scale. The drive part for two neighboring channels has a pair of registers 10L and 10R, a pair of first data latch circuits 12L and 12R, a pair of first switching circuits 14L and 14R, a pair of second data latch circuits 16L and 16R, a pair of level shifters 18L and 18R, a pair of D/A converters 20L and 20R, a pair of output amplifiers 22L and 22R, a pair of second switching circuits 24L and 24R, and a pair of output pads 26L and 26R. All K positive gray-scale voltages V1–VK are supplied to the left-side D/A converter 20L from gray-scale voltage generating circuit 28. On the other hand, all K negative gray-scale voltages V'K–V'1 are supplied to the right-side D/A converter 20R from gray-scale voltage generating circuit 28.

2 Claims, 9 Drawing Sheets

10L
10R
Register
Register
DXj
DXj+1
12L
12R
Data Latch
Data Latch
14L
14R
ST
ST
16L
16R
Data Latch
Data Latch
ST
28
VB
VK
VK−1
V'a
V1
V'1
V'b
V'K−1
V'K
VS
18L
18R
Level Shifter
Level Shifter
20L
20R
V1~VK
D/A converter
D/A converter
V'K~V'1
22L
22R
Output amplifier
Output amplifier
24L
24R
ST
ST
26L
26R
Output pad
Output pad Register
Data latch
Data latch
Level shifter
Decoder
Switch array (1)
Switch array (2)
Decoder
Output pad
ST
DXj
10
12
14
18
20A
20C
20B
22
26
28
30
3
8
5 of 9
V1~V64
V'64~V'1
VB
VS
V64
V63
V62
V61
V60
V59
V58
V57
V'64
V'63
V'62
V'61
V'60
V'59
V'58
V'57

Register
Data latch
Data latch
Level shifter
D/A Converter
Output amplifier
Output pad
ST
DXj
10
12
14
18
20
22'
26
28
30
V1~VK
V'K~V'1
VB
VS
VK
VK-1
VK-2
VK-3
VK-4
VK-5
VK-6
VK-7
V'K
V'K-1
V'K-2
V'K-3
V'K-4
V'K-5
V'K-6

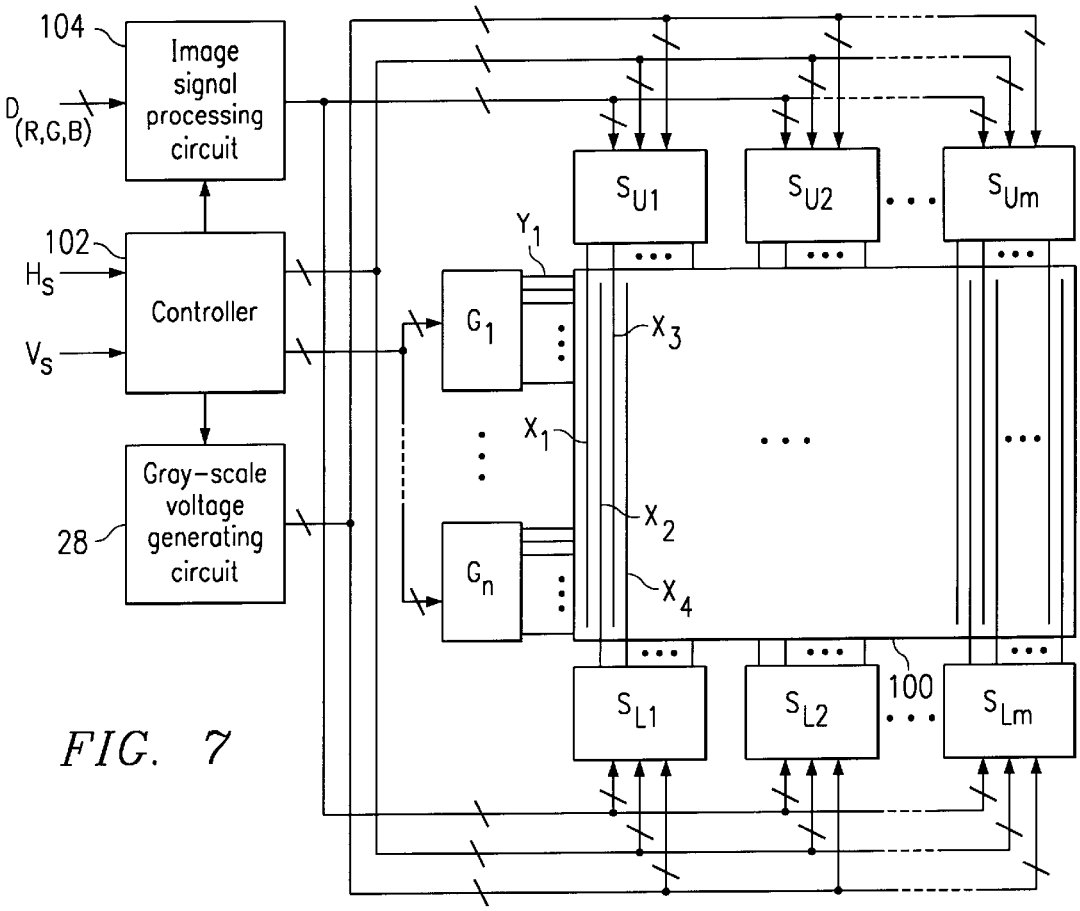
FIG. 7
FIG. 8
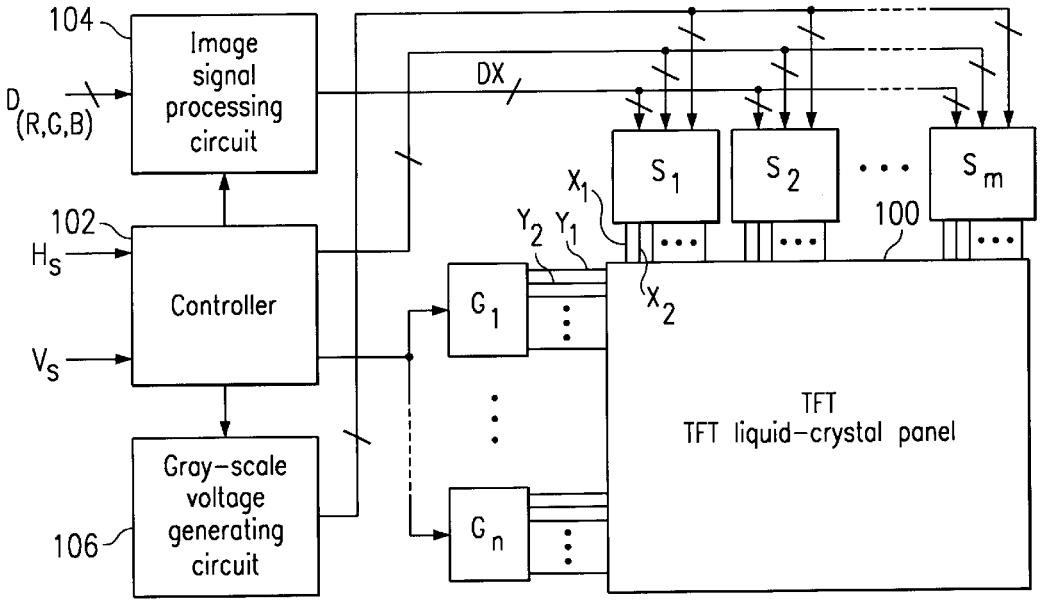

SIGNAL LINE DRIVING CIRCUIT FOR AN LCD DISPLAY

FIELD OF THE INVENTION

Our invention relates to drive circuits for LCD displays, and more particularly to a circuit for driving the signal lines of a multi-level gray-scale LCD display.

BACKGROUND OF THE INVENTION

As an example of an LCD display, FIG. 8 shows a schematic of an active-matrix thin-film transistor (TFT) color LCD display. A TFT liquid-crystal panel 100 has multiple gate lines Y1, Y2, . . . and multiple signal lines X1, X2, . . . which cross to form a matrix, and at each intersection point there is a thin film transistor for controlling a colored pixel (pixel) at that point. Gate line drivers G1, G2, . . . Gn are connected in parallel for driving the gate lines, and signal line (source) drivers S1, S2, . . . Sm are connected in parallel for driving the signal lines. A controller 102 controls the operation of each part. An image signal processing circuit 104 executes the necessary signal processing for the signals for the image to be displayed. A gray-scale voltage generating circuit 106 generates multiple-gray-scale voltages for enabling a full-color (multiple-gray-scale display).

Image signal processing circuit 104 supplies digital image data DX representing the gray-scale display of each pixel to the m signal line drivers. For example, with 64 gray-scale values, image data DL of 6 bits is provided to them signal line drivers from image signal processing circuit 104 for each red, green and blue (R,G,B) pixel. Controller 102 supplies various control or timing signals in synch with a horizontal synchronizing pulse HS and a vertical synchronizing pulse VS to the n gate line drivers and m signal line drivers. Gray-scale voltage generating circuit 104 provides multiple-level gray scale voltages corresponding to the 64 gray scale values achievable with the panel 100's V-T (voltage-transmissivity) characteristics.

The detailed construction of a typical liquid-crystal panel 100 is shown in FIG. 9. A liquid crystal material 114 is sealed or filled between lower and upper glass plates 110 and 112. On the inner surface of plate 110, a pixel electrode Pi,j and a corresponding thin-film transistor TFTi,j composed of a transparent conductive film are formed near each intersection of a signal line Xj (not shown) and gate line Yi (not shown). Pixel electrode Pi,j is connected to corresponding signal line Xj via transistor TFTi,j, and the gate electrode Tg which controls transistor TFTi,j is connected to corresponding gate line Yi.

The inner surface of the other plate 112 is covered with a color filter layer 115 having a pattern of red, green, and blue (RGB) filters for corresponding colored pixels, over which is a common opposing electrode 116 formed of a transparent conductive film. On the outside surfaces of glass plates 110 and 112, corresponding lower and upper polarizer layers 118 and 120 are provided whose respective polarization axes can be made either parallel or orthogonal to each other.

As shown in FIG. 9, a light source for backlighting is provided beneath lower polarizer 118 and the backlit display can be viewed from above through upper polarizer 120. Suppose the polarization axes of polarizer layers 118 and 120 are parallel to each other (e.g., both pointed into the page in FIG. 9). Assume that unactivated liquid crystal (no electric field applied) rotates the polarization axis of the backlight entering through polarizer layer 118 by 90° so it points to the left in FIG. 9 but activated liquid crystal (voltage applied between electrodes Pi,j and 116) does not rotate the backlight. In such case, the backlight (colored by filter 115) will only shine through polarizer layer 120 at those pixels where a voltage is applied between electrodes Pi,j and 116. If instead polarizer layers 118 and 120 are orthogonal to each other, the backlight will only shine through at those pixels where no voltage is applied.

In FIG. 9, Ts represents the transistor's source electrode, Td its drain electrode, 124 a semiconductor layer, 126 a protective film, 128 a gate-insulating film, and 130 a black matrix separating the various RGB filters.

The circuit configuration within liquid-crystal panel 100 is shown in FIG. 10. The liquid crystal material 114 sandwiched between each pixel electrode Pi,j and facing common electrode 116 forms a signal storage capacitor Cs. During each frame, the gate lines Y1, Y2, . . . are usually selected and driven active one line at a time in scan line order by the gate line drivers.

For example, if gate line Yi for line i is driven active, all transistors TFTi,1, TFTi,2, . . . of line i connected to gate line Yi are turned ON. Simultaneously, signal line drivers S1, S2, . . . output the analog gray-scale voltages for all the pixels of the i line, and these gray-scale voltages activate corresponding pixel electrodes Pi1, Pi2, . . . via signal lines X1, X2, . . . and "ON" transistors TFTi,1, TFTi,2, . . . .

Thereafter, gate line Yi is deactivated and gate line Yi+1 activated for the next line i+1, and the operation described above is executed for line i+1. When gate line Yi is deactivated, the transistors in line i turn OFF and the charge stored in each pixel of line i cannot escape its signal storage capacitor Cs, so the gray scale voltage level for each pixel electrode Pi1, Pi2, . . . is stored until the next time gate line Yi is selected.

Thus, a corresponding gray-scale voltage can be applied to each pixel electrode in one frame period, but to prevent degradation of the liquid-crystal molecules the polarity of the voltage applied must be alternated. In a TFT-LCD, there are two ways to apply alternating voltage to the liquid crystal material: the so-called common-fixed drive method and the common-inverting drive method.

As shown in FIG. 11, in the common-fixed drive method only the polarity of the voltage applied to the pixels alternates while the voltage applied to the common electrode 116 remains fixed. As shown in FIG. 12, in the common-inverting drive method, the polarities of both the voltage applied to the pixels and the common voltage are simultaneously alternated. That is, a positive voltage is applied to the pixel electrodes when common 116 electrode is negative, after which a negative voltage is applied to the pixel electrodes when common electrode 116 is positive.

The common-inverting drive method has the advantage of enabling a low-voltage driver to be used since the voltage amplification of the pixel electrode can be halved compared to the common-fixed process. However, it has the disadvantages that power consumption is high, because the large-capacitance common electrode 116 is driven with alternating current, and the display quality is inferior. In contrast, the common-fixed drive method has superior display quality and lower power consumption, although a low-voltage driver cannot be used. The common-fixed drive method is considered particularly suitable for large-screen TFT-LCD.

A conventional signal line driver circuit S using the common-fixed drive method is shown in FIG. 13. The circuit configuration of the drive portion for one signal line or one channel in such a signal line driver S is shown in FIG. 14.

In the conventional signal line driver S, an enable input signal EIO having pointing information, for example a "1", is input from controller 102 into a shift register 140. This EIO signal is shifted within shift register 140 in accordance with a clock signal to sequentially designate the data storage positions for each channel portion of data register 142, enabling one line of image data DX from image data signal processing circuit 104 to be serially input into data register 142. Next, controller 102 provides a strobe signal ST to a data latch circuit 144 to input the one line of image data DX in parallel from data register 142 to the data latch circuit 144.

Then the image data DX in data latch 144 is input to a voltage level shifter circuit 145, which adjusts the signal voltage level, for example from 5 volts to 10 volts. The voltage-level adjusted one line of image data is then input from level shifter 145 to a digital-to-analog (D/A) converter supplied with all the gray-scale voltages by gray-scale voltage generating circuit 106.

In the common-fixed drive method, in order to apply each of the desired gray-level voltages for both positive and negative terminals with respect to the common fixed voltage, the number of gray-level voltages employed is twice the number of gray-scale values. Therefore, for 64 gray-scale values, gray-scale voltage generating circuit 106 must generate 128 reference voltages: 64 positive gray-scale voltages V1–V64 as well as 64 negative gray-scale voltages V64'–V1'.

As shown in FIG. 14, in each channel a D/A converter 146*j* decodes the 6-bit (for 64 levels) image data for one pixel and then selects and outputs the corresponding positive or negative gray-scale voltage Vj corresponding to the indicated display gray scale level. Gray-scale voltage Vj output from D/A converter 146*j* is output to corresponding signal line Xj by an output amplifier 148*j*, which is normally composed of a voltage follower. Because the common-fixed drive method employes twice as many gray-scale voltages as gray-scale values, the circuit scale, particularly the D/A converter, is substantially enlarged. Because the D/A converter has a voltage range including both the positive and negative gray-scale voltages, it operates with twice the normal voltage system, making it impossible to keep the area of each transistor element from becoming large. Therefore, the circuit scale increases noticeably as a result of the number of transistor elements doubling. When the chip area of the signal line driver becomes large, in addition to the chip cost increasing, satisfying the required specifications for the package (principally a tape carrier package) becomes difficult.

Also, in the common-fixed drive method output amplifier 148*j* of each channel alternately operates between negative and positive voltage ranges. Consequently, the arithmetic amplifier of the voltage follower in output amplifier 148*j* must satisfy the linearity and offset characteristics in the source state, in which electric current is discharged from the output terminal, and the sink state, in which electric current is drawn to the output terminal, for all positive and negative gray-scale voltages, and very high precision is needed. This causes a great burden on manufacture and circuit design.

Therefore, an object of the present invention is to provide a signal line drive circuit for LCD displays that can alternate the voltage applied to the liquid crystal but has reduced chip size and circuit scale.

SUMMARY OF INVENTION

To achieve the objective, the first signal line drive circuit for LCD displays of our invention composed such that liquid crystals arranged in a matrix between a number of pixel electrodes and an opposing electrode are filled, each of the pixel electrodes is electrically connected to the corresponding signal line through the corresponding thin-film transistor, the control terminal of the thin-film transistor is electrically connected to the corresponding gate line, an opposing electrode voltage is applied to the opposing electrode, and gray-scale voltage, with a voltage level corresponding to the necessary display gray scale, is applied through the signal line and the thin-film transistor to each pixel electrode every time the gate line is driven, is provided with a first and, second D/A conversion means commonly connected to neighboring first and second signal lines of the LCD display and composed to respectively generate analog positive gray-scale voltages and negative gray-scale voltages in accordance with the opposing electrode voltage according to the digital gray-scale data representing the necessary display gray scale for an optional pixel electrode, and a switching means which alternately repeats, at a prescribed cycle, a first operation, in which the first digital/analog (D/A) conversion means generates the positive gray-scale voltage corresponding to the gray-scale data of the first signal line at the same time the second digital/analog conversion means generates negative gray-scale voltage corresponding to the gray-scale data of the second signal line, and a second operation, in which the first digital/analog conversion means generates the positive gray-scale voltage corresponding to the gray-scale data of the second signal line at the same time the second digital/analog conversion means generates the negative gray-scale voltage corresponding to the gray-scale data of the first signal line.

The second signal line drive circuit of our invention was composed so that, in the first signal line drive circuit, the switching means alternately repeats the first and second operations in the line cycle at which the gate line is driven by a sequential operation, and makes the pixel electrode alternately repeat the first and second operations in the frame cycle at which the gray-scale voltage is applied.

The third signal line drive circuit of our invention was composed so that, in the first or second signal line drive circuit, the output terminal of the first digital/analog conversion means is connected to the first and second signal lines via the switching means and a first output amplifier, which has an impedance converting function, and the output terminal of the second digital/analog conversion means is connected to the first and second signal lines via the switching means and a second output amplifier, which has an impedance converting function.

The fourth signal line drive circuit for LCD displays of our invention composed such that the liquid crystals arranged in a matrix between a number of pixel electrodes and an opposing electrode are filled, each of the pixel electrodes is electrically connected to the corresponding signal line through the corresponding thin-film transistor, the control terminal of the thin-film transistor is electrically connected to each corresponding gate line, an opposing electrode voltage is applied to the opposing electrode, and a gray-scale voltage, with a voltage level corresponding to the necessary display gray scale, is applied through the signal line and the thin-film transistor to each pixel electrode every time the gate line is driven, is provided with a first gray-scale voltage generating means, which has a positive polarity with respect to the opposing electrode voltage and generates a number of positive gray-scale voltages with voltage levels corresponding to each of all set display gray scales; a second gray-scale voltage generating means, which has a negative polarity with respect to the opposing electrode voltage and generates a number of negative gray-scale voltages with voltage levels corresponding to each of all set display gray scales; a gray-scale voltage selecting means, which is connected to the respective output terminals of the first and second gray-scale voltage generating means and alternately repeats, at a prescribed cycle, a first selection operation, which selects and outputs a number of positive gray-scale voltages from the first gray-scale voltage generating means, and a second selection operation, which selects and outputs a number of negative gray-scale voltages from the second gray-scale voltage generating means; and a digital/analog conversion means, which is provided with respect to each of the signal lines, decodes the digital gray-scale data representing the necessary display gray scale for one input pixel, selects one of the gray-scale voltages corresponding to the gray-scale data from the number of positive gray-scale voltages or the number of negative gray-scale voltages provided by the gray-scale voltage selecting means, and outputs it through the signal line.

In the first to third signal line drive circuits of our invention, alternating-current driving between the neighboring channels is carried out by making the first digital/analog conversion means dedicated to positive gray-scale voltages and the second digital/analog conversion means dedicated to negative gray-scale voltages in the drive part of two neighboring signal lines or channels and by alternately executing the first and second operations at a prescribed cycle using a switching means.

In the fourth signal line drive circuit of our invention, the digital/analog conversion means for each channel does not require that both positive and negative gray-scale voltages generated by the gray-scale voltage generating means be received simultaneously, so the necessary decoding operation can be carried out by inputting a gray-scale voltage of only one polarity corresponding to that of the alternating-current drive from the gray-scale voltage selecting means.

BRIEF DESCRIPTION OF DRAWINGS

FIG. 7 is a block diagram of a full-color TFT-LCD using the signal line driver of the second embodiment.

FIG. 8 is a block diagram typically showing the construction of a full-color TFT-LCD of an active-matrix system.

In the FIGS., 10, 10L, 10R are registers; 12, 12L, 12R first data latch circuits; 14L, 14R first switching circuits; 16, 16L, 16R second data latch circuits; 18, 18L, 18R level shifters; 20, 20L, 20R D/A converters; 22, 22L, 22R output amplifiers; and 24L, 24R are second switching circuits.

DETAILED DESCRIPTION

Figure 1:
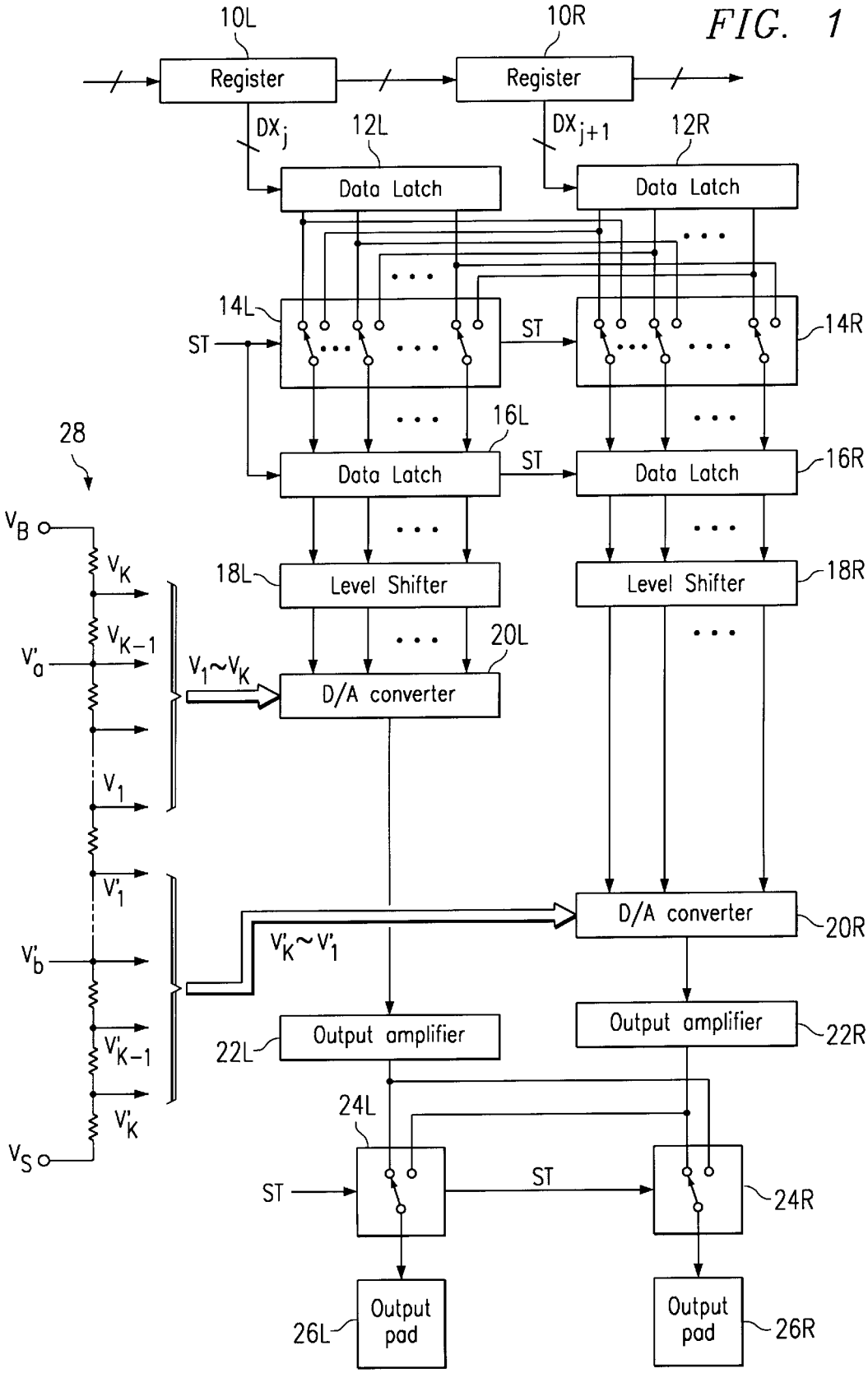
FIG. 1 is a block diagram of the main part of a signal line driver according to one embodiment of our invention.

Some embodiments of our invention will be explained below with reference to FIGS. 1–7. FIG. 1 shows a circuit configuration of the main part of a signal line driver according to one embodiment of our invention. More specifically, it shows the construction of the drive part for two neighboring channels. This signal line driver can be used, for example, in the full-color TFT-LCD of an active-matrix system shown in FIG. 8. It will be assumed that the drive part for the two neighboring channels shown in the fig. drives signal lines Xj and Xj+1 of neighboring row number j and row number j+1 of liquid-crystal panel 100 shown in FIG. 8.

In FIG. 1, the drive part for the two neighboring channels has a pair of registers 10L and 10R, a pair of first data latch circuits 12L and 12R, a pair of first switching circuits 14L and 14R, a pair of second data latch circuits 16L and 16R, a pair of level shifters 18L and 18R, a pair of D/A converters 20L and 20R, a pair of output amplifiers 22L and 22R, a pair of second switching circuits 24L and 24R, and a pair of output pads 26L and 26R.

Figure 13:
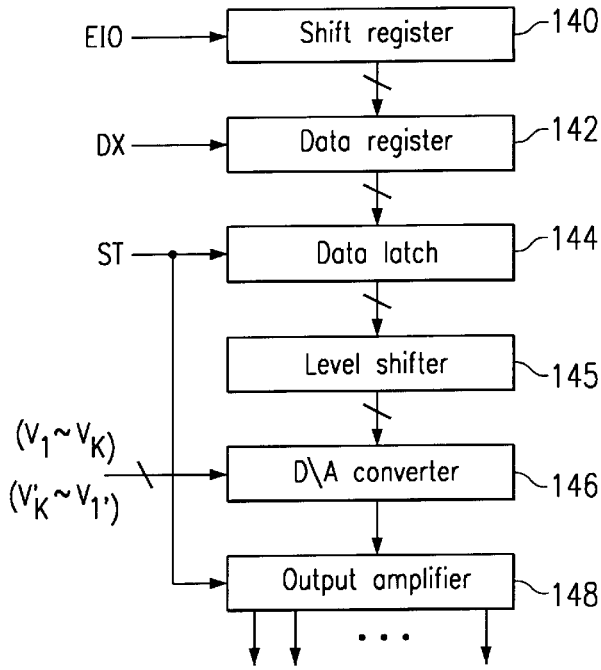
FIG. 13 is a block diagram of a conventional signal line driver.
Figure 14:
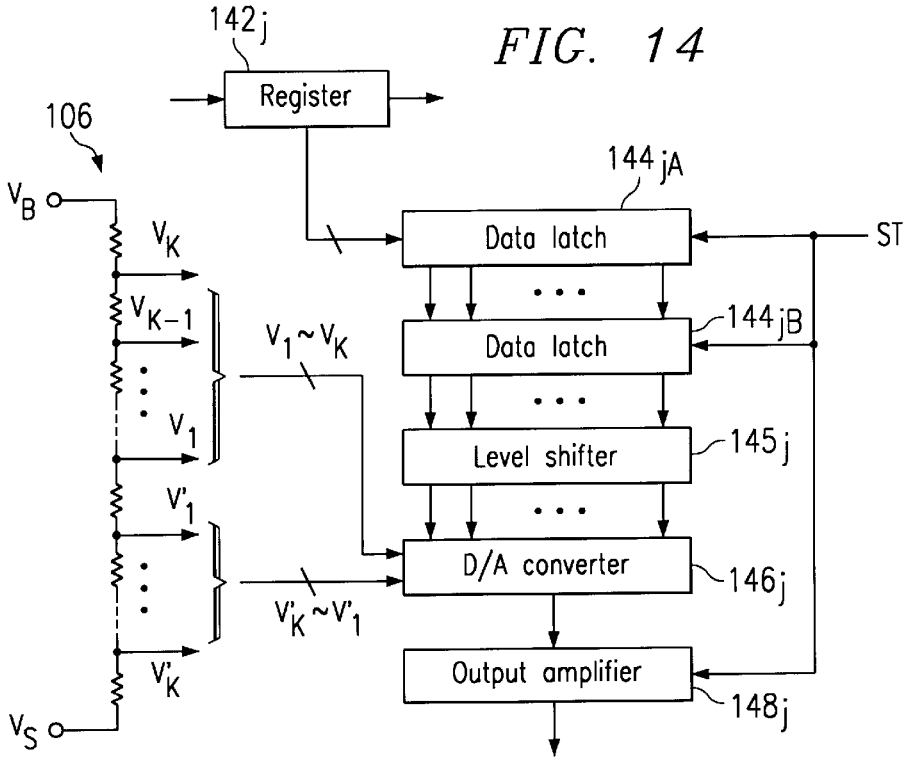
FIG. 14 is a block diagram of the drive part for one channel in a conventional signal line driver.

Registers 10L and 10R on the left side and the right side, respectively, correspond to the image data holding part for one pixel allocated to each corresponding channel in data register 142 of FIG. 13. In a prescribed cycle, for example, a line cycle, image data DXj and DXj+1 for one pixel having a prescribed number of bits is respectively input to first data latch circuits 12L and 12R on the left side and right side from registers 10L and 10R.

The output terminal of the left-side first data latch circuit 12L is connected to one (left side) input terminal of the left-side first switching circuit 14L and is connected to the other (right side) input terminal of the right-side first switching circuit 14R for each bit. The output terminal of the right-side first data latch circuit 12R is connected to one (left side) input terminal of the right-side first switching circuit 14R and is connected to the other (right side) input terminal of the left-side first switching circuit 14L for each bit.

First switching circuits 14L and 14R on the left side and the right side are alternately switched between one (left side) input terminal and the other (right side) input terminal according to alternating-current signal ST from a controller (not shown in the fig.). The output terminals of the left-side and right-side first switching circuits 14L and 14R are connected to the respective input terminals of the left-side and right-side second data latch circuits 16L and 16R.

The left-side and right-side second data latch circuits 16L and 16R input image data for one pixel from either the left-side first data latch circuit 12L or the right-side first data latch circuit 12R via the left-side and right-side first switching circuits 14L and 14R at a timing in synch with alternating-current signal ST. The output terminals of the left-side and right-side second data latch circuits 16L and 16R are connected respectively to the input terminals of the left-side and right-side D/A converters 20L and 20R via the left-side and right-side level shifters 18L and 18R.

Level shifters 18L and 18R convert the logical voltage (e.g., 5 V) of the image data to a high voltage (10 V) so that the circuit elements within D/A converters 20L and 20R can handle both positive and negative gray-scale voltages according to the common-fixed drive method.

All K positive gray-scale voltages V1–VK are supplied to the left-side D/A converter 20L from gray-scale voltage generating circuit 28. On the other hand, all K negative gray-scale voltages V'K–V'1 are supplied to right-side D/A converter 20R from gray-scale voltage generating circuit 28.

Gray-scale voltage generating circuit 28 is composed of, for example, a resistance-type voltage dividing circuit and a correction reference voltage (V) is supplied to the connection point (node) at the suitable location so that each gray-scale voltage with a voltage level corresponding to each display gray scale can be obtained according to the V-T characteristics of liquid-crystal panel 100.

For example, when alternately applying negative gray-scale voltages (5–0 V) and positive gray-scale voltages. (5–10 V) of positive polarity to each pixel electrode by fixing the voltages of the opposing electrode at 5 V in the common-fixed drive method, the maximum positive gray-scale voltage VK is set to a value close to 10 V, the maximum negative gray-scale voltage V'K is set to a value close to 0 V, and the maximum gray-scale voltages V1 and V'1 of both polarities are set to about 5 V.

The left-side D/A converter 20L is composed to decode the image data for one pixel that is input from the left-side level shifter 18L and to select and output a positive gray-scale voltage Vx with a voltage level corresponding to the display gray scale represented by the corresponding image data. On the other hand, the right-side D/A converter 20R is composed to decode the image data for one pixel that is input from the right-side level shifter 18R and to select and output a negative gray-scale voltage V'x with a voltage level corresponding to the display gray scale represented by the corresponding image data. The output terminals of the left-side and right-side D/A converters 20L and 20R are respectively connected to the input terminals of the left-side and right-side output amplifiers 22L and 22R.

The left-side output amplifier 22L is composed of a voltage follower of an arithmetic amplifier with an impedance converting function and is composed to operate in the sink state within the range of positive voltages. The output terminal of the left-side output amplifier 22L is connected to one (left side) input terminal of the left-side second switching circuit 24L and is connected to the other (right side) input terminal of the right-side second switching circuit 24R.

The right-side output amplifier 22R is composed of a voltage follower of an arithmetic amplifier with an impedance converting function and is composed to operate in the source state within the range of negative voltages. The output terminal of the right-side output amplifier 22R is connected to one (left side) input terminal of the right-side second switching circuit 24R and is connected to the other (right side) input terminal of the left-side second switching circuit 24L.

The left-side and right-side output terminals of second switching circuits 24L and 24R are respectively connected to signal lines Xj and Xj+1 (not shown in the fig.) of each corresponding channel via the left-side and right-side output pads 26L and 26R.

Next, the operation of the signal line driver according to this embodiment will be explained. In the TFT-LCD which includes this signal line driver, gate lines Y1, Y2, . . . of liquid-crystal panel 100 are normally selected one line at a time by a sequential operation within one frame period and driven in the active state by gate line drivers G1, G2, . . . Every time each gate line Yj is driven, gray-scale voltage Vj to be applied to each of the corresponding pixel electrodes on the pertinent line is output from output pad 26 of each channel in each signal line, driver.

Presently, it will be assumed that first switching circuits 14L and 14R and second switching circuits 24L and 24R are respectively switched to one (left side) input terminal when gate line Yi of line i is driven. At this time, image data DXi,j and DXi,j+1 representing the display gray scale of two pixels respectively positioned at line i, row j and line i, row (j+1) within liquid-crystal panel 100 are stored in first data latch circuits 12L and 12R.

In this case, at the same time the image data DXi,j for one pixel is being transmitted to the left-side second data latch circuit 16L via the left-side first switching circuit 14L from the left-side first data latch circuit 12L according to the timing of alternating-circuit signal ST, image data DXi,j+1 for one pixel is transferred to the right-side second data latch circuit 16R via the right-side first switching circuit 16R from the right-side first data latch circuit 12R.

Image data DXi,j and DXi,j+1 for one pixel input to the left-side and right-side second data latch circuits 16L and 16R is input respectively to the left-side and right-side D/A converters 20L and 20R via the left-side and right-side level shifters 18L and 18R.

Accordingly, positive gray-scale voltage Vj with a voltage level corresponding to the display gray scale represented by image data DXj is output from the left-side D/A converter 20L. On the other hand, negative gray-scale voltage V'j+1 with a voltage level corresponding to the display gray scale represented by image data DXi,j+1is output from the right-side D/A converter 20R.

The positive gray-scale voltage Vj output from the left-side D/A converter 20L is output to signal line Xj from the left-side output pad 26L via the left-side output amplifier 22L and second switching circuit 24L and is applied to pixel electrode Pi,j via TFTi,j of line i connected to the signal line Xj.

On the other hand, the negative gray-scale voltage Vj+1 output from the right-side D/A converter 20R is output to signal line Xj+1 from the right-side output pad 26R via the right-side output amplifier 22R and second switching circuit 24R and then applied to pixel electrode Pi,j+1 via TFTi,j+1 of line i connected to the signal line Xj+1.

Next, when gate line Yi+1 of line i+1 is driven, first switching circuits 14L and 14R and second switching circuits 24L and 24R are respectively switched simultaneously with the other (right side) input terminal according to the alternating-current signal ST.

In this way, simultaneously with the transfer of the image data DXi+1,j for one pixel corresponding to signal line Xi to the right-side second data latch circuit 16R via the right-side first switching circuit 14R from the left-side first data latch circuit 12L, image data DXi+1,j+1 for one pixel corresponding to signal line Xi+1 is transferred to the left-side second data latch circuit 16L via left-side first switching circuit 14L from the right-side first data latch circuit 12R.

Image data DXi+1,j+1 for one pixel input to the left-side and right-side second data latch circuits 16L and 16R is respectively input to the left-side and right-side D/A converters 20L and 20R via the left-side and right-side level shifters 18L and 18R.

In this way, positive gray-scale voltage Vj+1 with a voltage level corresponding to the display gray scale represented by image data DXi+1,j+1 is output from the left-side D/A converter 20L. On the other hand, the negative gray-scale voltage V'j with a voltage level corresponding to the display gray scale represented by image data DXi+1,J is output from the right-side D/A converter 20R.

The positive gray-scale voltage Vj+1 output from the left-side D/A converter 20L is output to signal line Xj+1 from the right-side output pad 26R via the left-side output amplifier 22L and the right-side second switching circuit 24R, and applied to corresponding pixel electrode Pi+1,j+1 via TFTi+1,j+1 of line i+1 connected to the signal line Xj+1.

On the other hand, the negative gray-scale voltage V'j output from the right-side D/A converter 20R is output to signal line Xj from the left-side output pad 26L via the right-side output amplifier 22R and the left-side second switching circuit 24L, and is applied to the corresponding pixel electrode Pi+1,j via TFTi+1,j of line i+1 connected to the signal line Xj.

Thereafter, the operation is repeated for two lines. In this way, the polarity of the gray-scale voltage reverses for each pixel in the Y direction of liquid-crystal panel 100. Also, the polarity of the gray-scale voltage reverses (between two neighboring signal lines Xj and Xj+1 for each pixel in the X direction. By thus reversing the polarity of the gray-scale voltage in the neighboring signal lines and pixel electrodes, the currents flowing through the pixel electrode, opposing electrode, etc., are offset, and decreases in the display quality is thereby suppressed.

Figure 11:
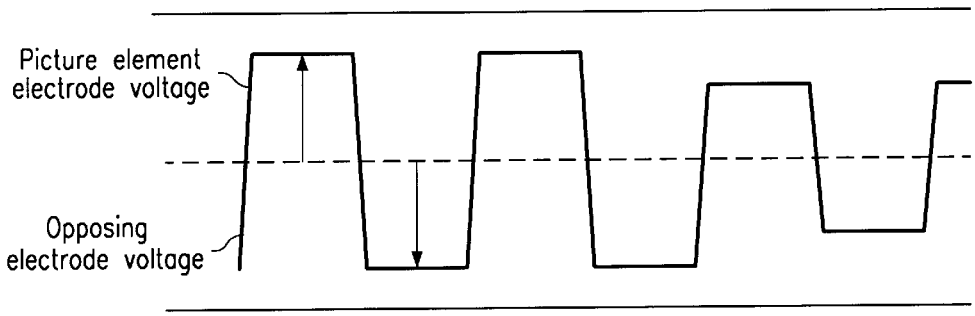
FIG. 11 shows the voltage waveforms for the pixel electrode voltage and opposing electrode voltage according to the common-fixed drive method.
Figure 12:
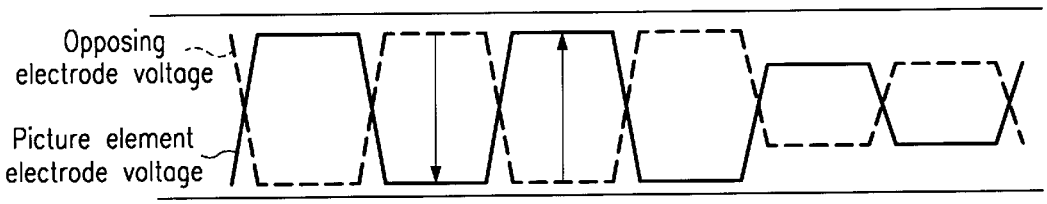
FIG. 12 shows the voltage waveforms for the pixel electrode voltage and opposing electrode voltage according to the common-inverting drive method.
Figure 10:
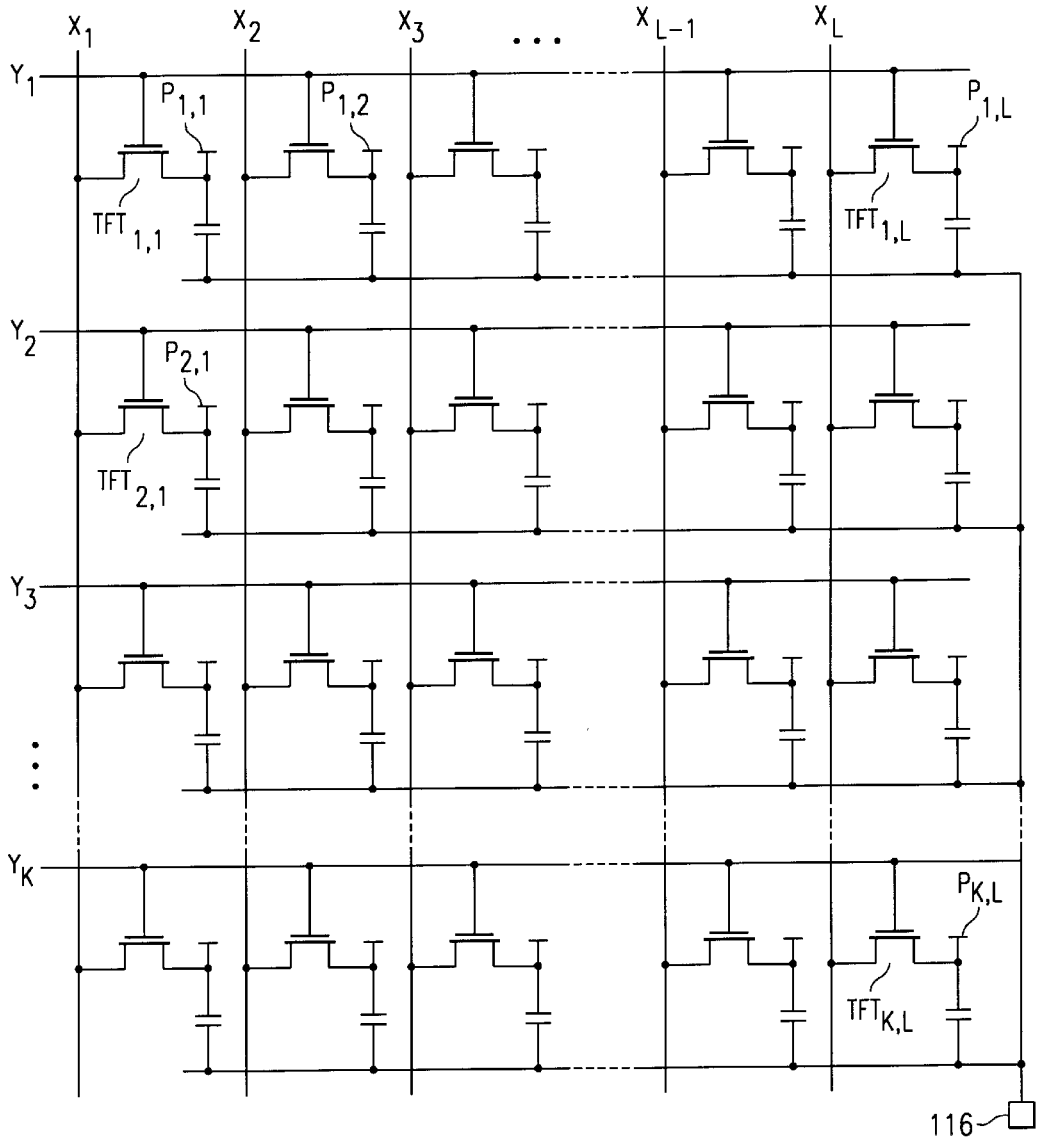
FIG. 10 is a circuit diagram of the circuit within a TFT-LCD liquid-crystal panel.

Switching circuits 14L, 14R, 24L, and 24R are controlled so as to be switched for each frame (namely, so that the position of switching circuits 14L, 14R, 24L, and 24R reverses for each frame when gate line Yi of each line is driven) according to alternating-current signal ST. With this type of reversal of the frame cycle, an electrode voltage waveform according to the common-fixed drive method like that shown in FIG. 11 is obtained.

As noted above, in the signal line driver according to the present embodiment, the common-fixed drive method) and dot reversal (reversal of every pixel) is realized by making the left-side D/A converter 20L and output amplifier 22L dedicated to positive gray-scale voltages and making the right-side D/A converter 20R and output amplifier 22R dedicated to negative gray-scale voltages in the drive part for two neighboring channels, and switching first switching circuits 14L and 14R provided prior to D/A converters 20L and 20R and second switching circuits 24L and 24R provided after output amplifiers 22L and 22R in a prescribed cycle, for example, line cycle and frame cycle. D/A converters 20L and 20R for one channel only have to handle a number of gray-scale voltages of one polarity equal to the number of display gray scales so only half of the transistor elements are necessary compared to the conventional technology and the circuit scale can be decreased by half.

Output amplifiers 22L and 22R must operate normally in either the sink state or the source state for the range of gray-scale voltages for one polarity. Consequently, along with the circuit scale for one channel becoming small in output amplifiers 22L and 22R, the dynamic range, linearity, and offset characteristics can be easily obtained, and the burden on the manufacture process and circuit design can be reduced.

Figure 2:
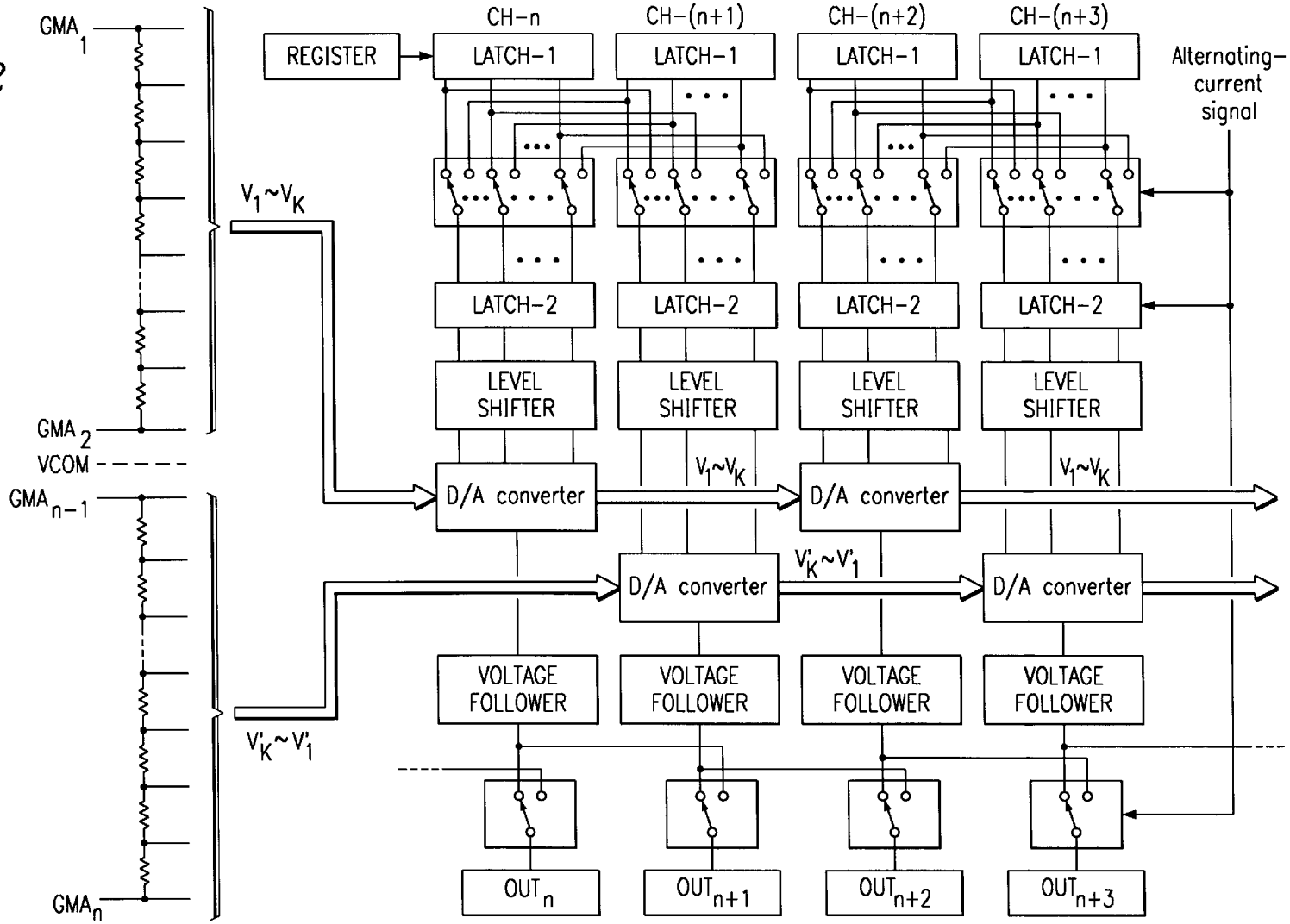
FIG. 2 is a block diagram of the main part of a signal line driver according to a modification of the embodiment in FIG. 1.

In the aforementioned embodiment, output switching of switching circuits 24L and 24R is mutually executed between two neighboring channels, but the same effect can be obtained even with a simultaneous switching system like that shown in FIG. 2. In FIG. 2, the construction of each part other than the switching circuit is the same as the construction of each corresponding part in FIG. 1.

Figure 3:
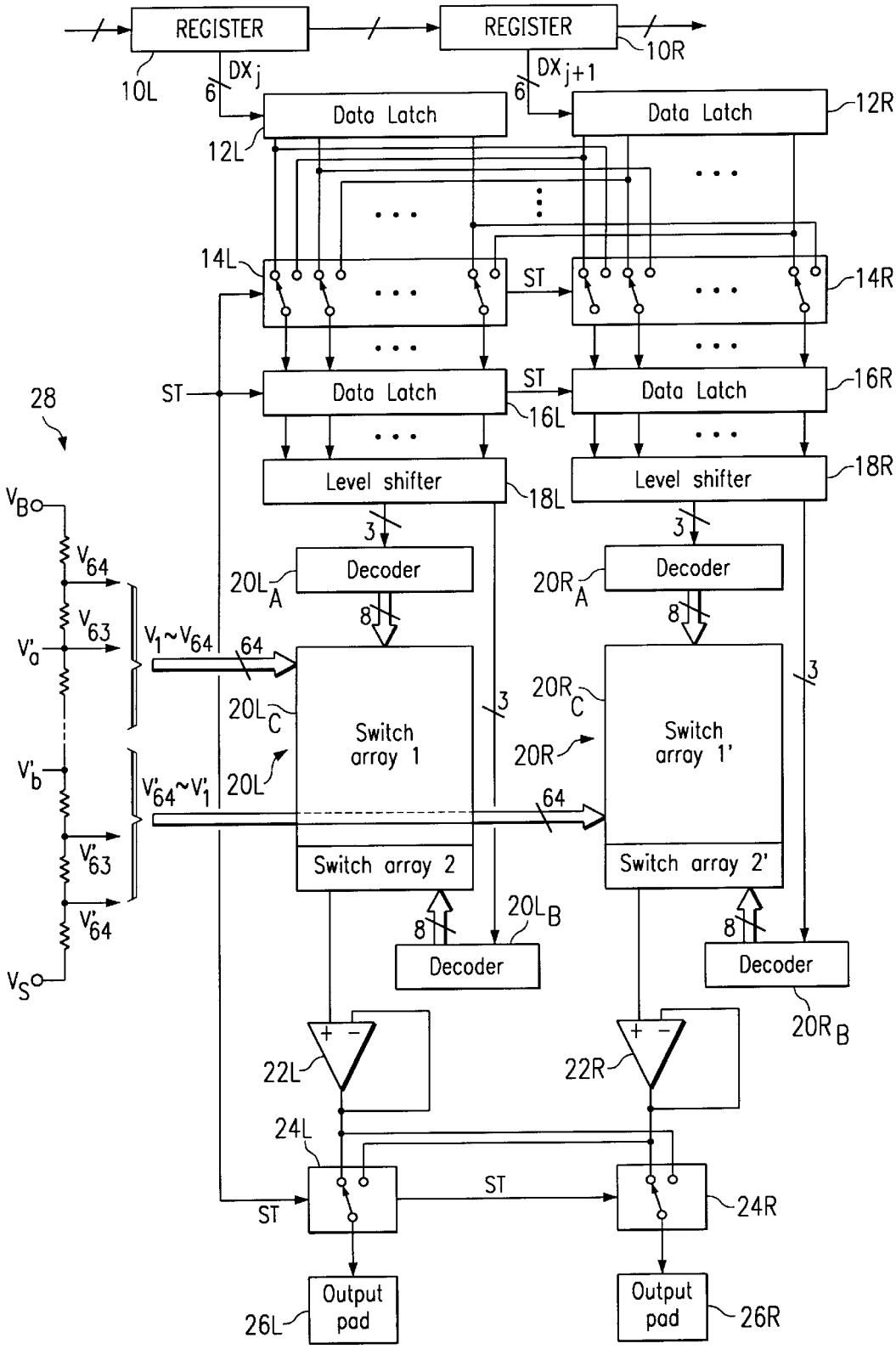
FIG. 3 is a block diagram of the main part of the driver when the signal line driver in the embodiment is applied to a TFT-LCD with 64 gray-scale values.
Figure 4:
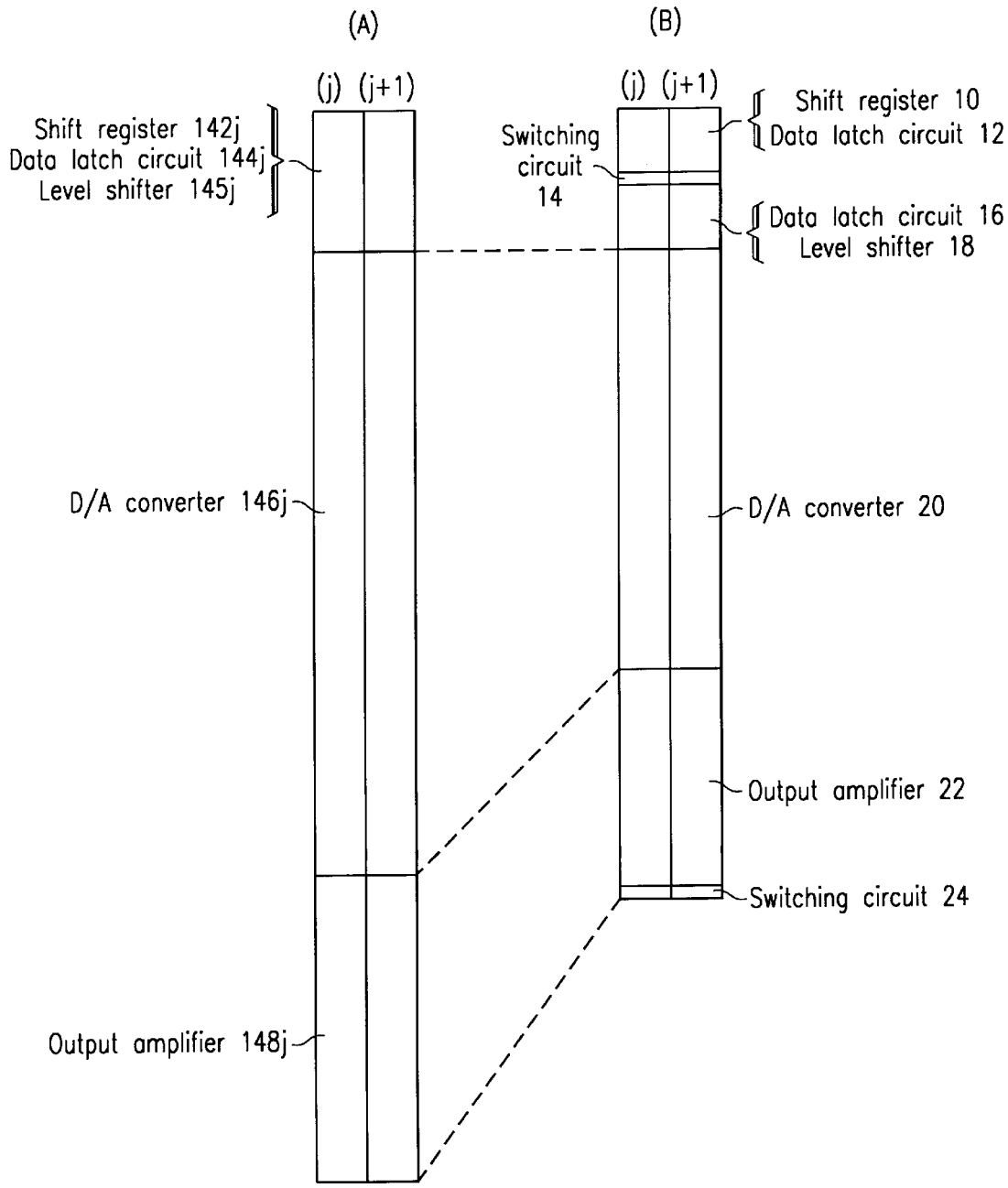
FIG. 4 shows an example of a circuit for the drive part for two channels according to an embodiment in a semiconductor integrated circuit.

The circuit configuration of the main part of the driver in a case in which the signal line driver of the present embodiment is applied to a TFT-LCD of 64 gray-scale values, more specifically, the circuit configuration of a D/A converter is shown in FIG. 3. Parts that are the same as those in FIG. 1 are indicated with the same reference numerals.

In this constructional example, two sets of image data DXj and DXj+1, which represent the display gray scale for one pixel with 6 bits, are selectively input to the left-side and right-side D/A converters 20L and 20R via registers 10L and 10R to level shifters 18L and 18R.

The left-side D/A converter 20L is composed of upper-order and lower-order decoders $\mathbf{20}_{LA}$ and $\mathbf{20}_{LB}$ with 3-bit input and two step switch arrays 1 and 2 $\mathbf{20}L_c$ composed of a transfer.gate.

Initial step switch array 1 is supplied with all 64 positive gray-scale voltages V1–V64 from gray-scale voltage generating circuit 28. Out image data DXj or DXj+1 of 6 bits provided from the left-side level shifter 18L, the upper-order 3 bits are input to upper-order decoder $\mathbf{20}_{LA}$. Upper-order decoder $\mathbf{20}_{LA}$ selects one set 8 from the 64 positive gray-scale voltages V1–V64 input to initial-step switch array 1 and transmits it to final step switch array 2. The lower-order 3 bits of image data DXj or Dxj+1 from the left-side level shifter 18L are input to lower-order decoder $\mathbf{20}_{LB}$. Lower order decoder $\mathbf{20}_{LB}$ selects one Vj or Vj+1 from the 8 gray-scale voltages input to switch array 2 and outputs it from switch array 2.

The right-side D/A converter 20R has the same circuit configuration as the left-side D/A converter 20L and each part operates in the same manner as each corresponding part of the left-side D/A converter 20L. However, all 64 negative gray-scale voltages V'64–V'1 are supplied to, initial step switch array 1' from gray-scale voltage generating circuit 28. Therefore, when image data DXj+1 or DXj of 6 bits is input to decoder $\mathbf{20}_{RA}$ and $\mathbf{20}_{RB}$ from the right-side level shifter 18R, negative gray-scale voltage V'j+1 or V'j with a voltage level corresponding to the display gray scale expressing represented by the corresponding image data is output from final step switch array 2.

One example of a circuit layout for the drive part for two channels in FIG. 2 in a semiconductor integrated circuit is shown in FIG. 4B. FIG. 4A is a circuit layout for the drive part for two channels in a conventional signal line driver.

Both are for 64 gray scales, but in the conventional driver A, the D/A converter for one channel handles 128 positive and negative gray-scale voltages, whereas, in the circuit of the present embodiment B, the D/A converter for one channel only has to handle 64 positive or negative gray-scale voltages, reducing the circuit area by half. Also, even in the output amplifier for one channel, which has a circuit configuration for both sink and source use in the conventional driver A, circuit configuration for either sink or source use can be used in the circuit of the present embodiment B, making the circuit area is much smaller.

In the aforementioned embodiment, various modifications are possible. For example, D/A converter 20 can be constituted with an optional logic circuit and can be composed with a ROM decoder. Various formats can also be applied for the data transfer means of register 10, data latch circuits 12 and 16, etc. Level shifter 18 can be omitted depending on necessity when, for example, the signal line driver of the present embodiment utilizes the common-inverting drive method. Also, even output amplifier 22 can be omitted depending on necessity when, for example, impedance matching can be achieved between the liquid-crystal panel and the driver. Also, the switching cycle of switching circuits 14 and 24 can be optionally set and switched, for example, for every few lines.

Figure 5:
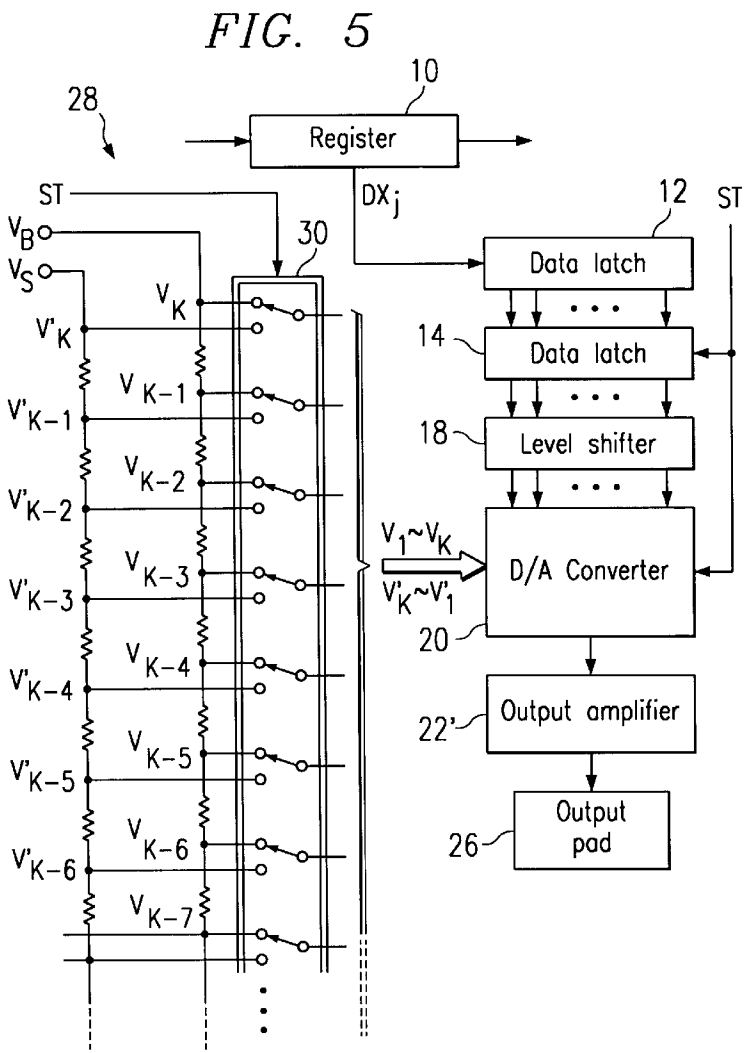
FIG. 5 is a block diagram of the drive part for one channel in the signal line driver according to the second embodiment of our invention.
Figure 9:
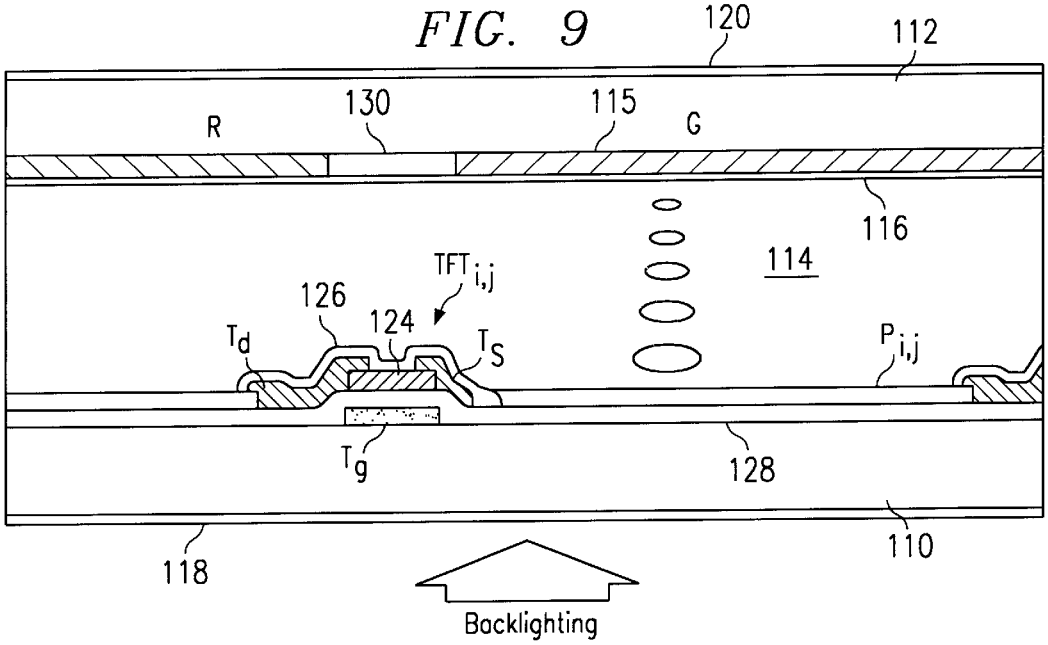
FIG. 9 is a partially sectioned view showing a typical construction of a TFT-LCD liquid-crystal panel.

Next, another embodiment of our invention will be explained with reference to FIGS. 5–7. FIG. 5 shows the construction of the drive part for one channel in the signal line driver according to this second embodiment. The main characteristic in the construction of this embodiment is that selecting circuit 30 is provided between gray-scale voltage generating circuit 28 and D/A converter 20.

This selecting circuit 30 has a number of K first input terminals a which input all positive gray-scale voltages V1–VK from the positive gray-scale voltage generation part of gray-scale voltage generating circuit 28 and a number of K second input terminals b which input all negative gray-scale voltages V'K–V'1 from the negative gray-scale voltage generation part of gray-scale voltage generating circuit 28, and alternately outputs positive gray-scale voltages V1–VK or negative gray-scale voltages V'1–V'K at a prescribed cycle to alternating-current signal ST.

According to the construction, D/A converter 20 does not have to input both positive polarity and negative gray-scale voltages simultaneously and only has to execute the necessary decoding operation by inputting gray-scale voltages of one polarity corresponding to each polarity of the alternating-current drive from selecting circuit 30, allowing the circuit scale to be small. Naturally, output amplifier 22' operates with respect to both positive polarity and negative gray-scale voltages so a circuit configuration with both the sink and source functions like in the conventional technology is realized.

In the signal line driver according to this embodiment, the drive part for each channel is parallel and independent and switching circuits 14 and 24 are not provided as in the aforementioned embodiment.

Figure 6:
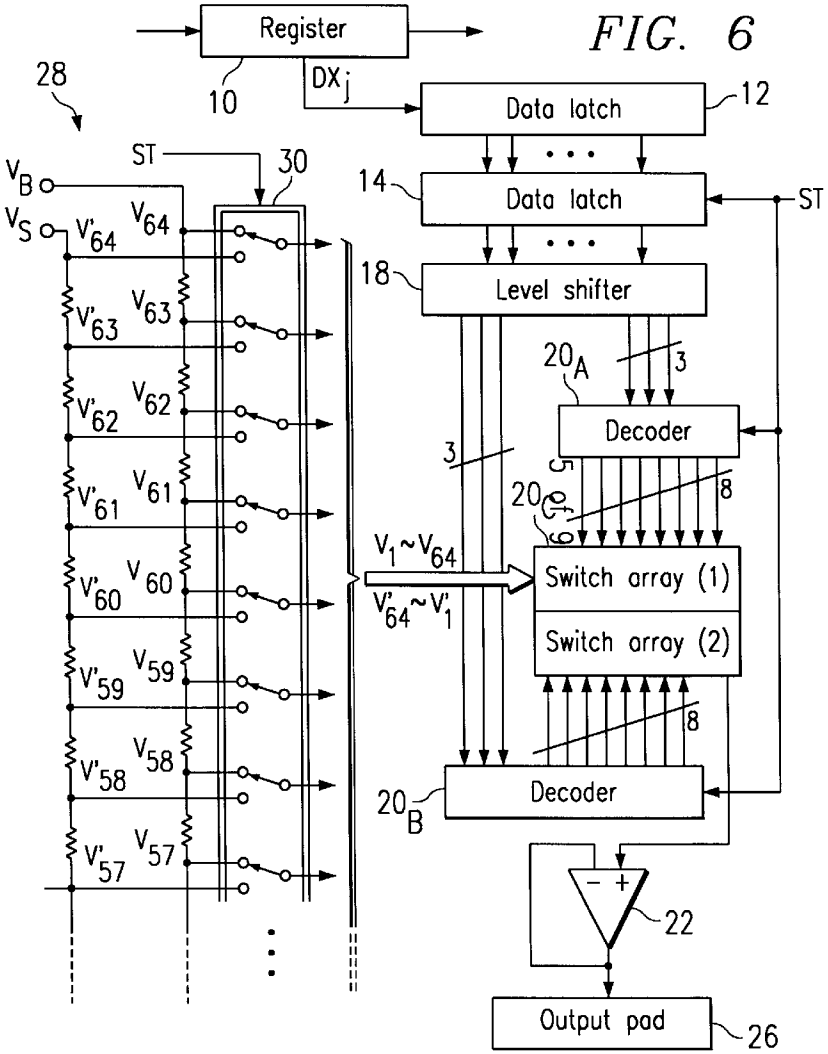
FIG. 6 is a block diagram of the main part of the driver when the signal line driver according to the second embodiment is applied to a TFT-LCD with 64 gray-scale values.

The circuit configuration of the main part of the driver when the signal line driver of this embodiment is applied to, for example, a TFT-LCD with 64 gray-scale values, more specifically, the circuit configuration of a D/A converter, is shown in FIG. 6.

The signal line driver of this embodiment outputs gray-scale voltages of temporarily identical polarity from the driver part for all channels. To execute dot reversal using this type of signal line driver, arrange signal line drivers SU and SL respectively on both sides (upper side and lower side) of liquid-crystal panel 100 as shown in FIG. 7 and allocate two neighboring signal lines to the upper signal line driver SU and lower signal line driver SL.

In FIG. 7, the aforementioned selecting circuit 30 is built into each signal driver SU and SL. To execute dot reversal, switching control must be executed such that selecting circuit 30 in each lower signal line driver SL1, SL2, . . . , selects negative gray-scale voltages V'K–V'1 when switching circuit 30 in each upper signal line driver SU1, SU2, . . . , is selecting positive gray-scale voltages V1–VK, and switching circuit 30 in each lower signal line driver SL1, SL2, . . . , selects positive gray-scale voltages V1–VK when switching circuit 30 in each upper signal line driver SU1, SU2, . . . , is selecting negative polarity gray scale voltages V'K–V'1.

In FIGS. 1, 4, and 5, 20L, 20R, 20, and 146*j* represent D/A converters, but these are essentially decoder circuits and are considered D/A converters based on the fact that digital data is being converted into analog voltages.

As explained above, according to the signal line drive circuit for LCD displays of our invention, the circuit scale of the analog digital converting means for selectively outputting an analog gray-scale voltage complying with the digital image data in the drive part for each channel can be made quite small. Furthermore, the circuit scale of the output amplifier in the drive part for each channel can be made small and can easily satisfy the characteristics/specifications, such as the dynamic range, etc. Therefore, simplification in the manufacture and design and considerable reduction in the chip size can be realized.

What is claimed is:

1. A signal line drive circuit for an LCD having multiple lines of pixels arranged in columns, each pixel being coupled to a gate line terminal for receiving an activating voltage for the pixel, a common voltage terminal, and a signal line terminal for receiving an analog gray-scale voltage relative to the common voltage terminal for specifying the brightness of that pixel, said signal line drive circuit comprising for adjacent paired columns of the display:

a common terminal for coupling to the LCD's common voltage terminal;

first and second gray scale data terminals for receiving first and second digital gray-scale signals;

first and second D/A conversion circuits for common coupling to neighboring first and second signal line terminals of the LCD, for respectively generating positive and negative analog gray-scale voltages; and a first switching circuit for cycling the first and second D/A conversion circuits between a first operation, in which the first D/A conversion circuit generates a positive gray-scale voltage responsive to the first gray-scale data at the same time the second D/A conversion circuit generates a negative gray-scale voltage responsive to the second gray-scale data, and a second operation, in which the first D/A conversion circuit generates a positive gray-scale voltage responsive to the second gray-scale data at the same time the second D/A conversion circuit generates a negative gray-scale voltage responsive to the first gray-scale data; and a second switching circuit coupling an output of the first D/A conversion circuit to a first of the adjacent columns of the display and an output of the second D/A conversion circuit to a second of the adjacent columns of the display in the first operation, the second switching circuit coupling the output of the first D/A conversion circuit to the second of the adjacent columns of the display and the output of the second D/A conversion circuit to the first of the adjacent columns of the display in the second operation.

2. The signal line drive circuit of claim 1 wherein the first D/A conversion circuit has a first output terminal coupled to the first and second signal line terminals via the switching circuit and a first output amplifier having an impedance converting function, and the output terminal of the second D/A conversion circuit coupled to the first and second signal line terminals via the switching circuit and a second output amplifier having an impedance converting function.

* * * * *